US005215284A

United States Patent [19]

Hungerford

[11] Patent Number: 5,215,284

[45] Date of Patent: Jun. 1, 1993

[54] SUPPORT CLIPS FOR MODULAR AIR BAR

[76] Inventor: John W. Hungerford, 7217 San Lucas, Carlsbad, Calif. 92009

[21] Appl. No.: 709,339

[22] Filed: Jun. 3, 1991

[51] Int. Cl.[5] ..... F24F 13/06

[52] U.S. Cl. ..... 248/225.1; 52/488; 454/301

[58] Field of Search ..... 248/223.4, 274.1, 224.2, 248/225.1, 201; 211/94; 52/488, 489, 775; 454/301, 303, 304

[56] References Cited

U.S. PATENT DOCUMENTS 2,727,272 12/1955 Hankin et al. ..... 248/223.4 X
2,992,743 7/1961 Wing ..... 211/94 X
3,828,508 8/1974 Moeller ..... 52/489
3,855,909 12/1974 Lambert ..... 52/488
4,130,975 12/1978 Kelley ..... 52/489

FOREIGN PATENT DOCUMENTS 843290 5/1952 Fed. Rep. of Germany ..... 211/94

*Primary Examiner*—Alvin C. Chin-Shue
*Attorney, Agent, or Firm*—John M. Harrison

[57] ABSTRACT

Support clips for mounting a modular air bar in the wall or ceiling system of a structure, which modular air bar is characterized by a pair of spaced air deflectors having curved, facing interior air channels and fitted with horizontally-spaced top and bottom spacers at each end. Ceiling clips serve to engage the ceiling and air bar in a and wall ceiling installation and wall clips are shaped for mounting on the wall of a structure when the air bar is installed in a ceiling adjacent to a wall.

3 Claims, 2 Drawing Sheets

SUPPORT CLIPS FOR MODULAR AIR BAR

BACKGROUND OF THE INVENTION

1. Field of the Invention

This invention relates to linear air diffusers and more particularly, to ceiling and wall clips for supporting a linear and modular air bar that serves to diffuse air in a selected pattern from the ceiling or wall plenum of a structure. In a preferred embodiment of the invention the ceiling clips are shaped to engage and mount on the ceiling and on a modular air bar characterized by a pair of vertically-spaced deflectors connected by spacers at each end, which spacers slidably contain a pair of pattern controllers that extend along the length of the deflectors. The deflectors are fitted with oppositely-disposed, curved air channels which terminate at a common air slot, in order to receive air from the plenum and direct the air according to the position of the slidably mounted pattern controllers, into a room of the structure. Spaced connector flanges are provided on each side of the air bar to receive the ceiling clips and mount the air bar on the ceiling or wall of a structure. In a second embodiment, both ceiling and wall clips are used to mount an air bar to the ceiling and wall of a structure under circumstances where the air bar is located in the ceiling adjacent to a wall.

The use of suspended ceilings which extend downwardly from the permanent ceiling or roof of a building or structure has become widespread and esthetic considerations require that lighting fixtures, air conditioning outlets and like equipment and accessories be flush-mounted with the suspended ceiling. The space between the suspended and permanent ceiling is known as a "plenum" and usually receives air conditioning ducts, cables, piping and similar equipment. This type of construction permits numerous air handling problems, particularly in large structures, since changes in the number and location of personnel occupying such structures often require frequent and extensive adjustment of the air distribution mechanism, in order to effectively provide suitable air handling and conditioning. The older diffusion outlets which extend below the plane of a suspended ceiling are not normally used in modern construction designs and these older fixtures usually require highly specialized and sometimes expensive extrusions which greatly increase the cost of the air conditioning installation.

Suspended ceiling-integrated air distribution systems require the following components: a plenum, an air chamber or chambers which are designed to collect air from a source of supply; an air diffuser assembly to distribute the air to a designated room or rooms in the structure; a support system for mounting the air diffuser assembly in communication with the plenum; and a return air system for returning the air from the room or rooms to the source of supply. This application details shaped ceiling and wall clips for mounting air diffusion units such as the modular air bar detailed in my U.S. Pat. No. 4,869,157, which issued on Sep. 26, 1989.

2. Description of the Prior Art

Many of the structures which have been proposed and used for air handling and distribution systems in connection with suspended ceilings, suffer from a common disadvantage, in that they must be assembled and supported at the suspended ceiling level. This method of assembly is difficult and usually results in a very high, and sometimes prohibitive, labor cost.

While the various air diffusing and suspension and mounting systems disclosed in the prior art detail apparatus for creating a diffused air flow which operate successfully in many applications, there are some instances where mounting the unit in a way or ceiling to facilitate a more focused air flow, as well as multiple streams of air from a single diffuser, are highly desirable. This is particularly true for air handling and conditioning systems that must operate in a structure characterized by a non-homogeneous temperature, such as a room that contains large glass windows which are exposed to either a significantly hotter or colder external environment. These windows tend to be highly conductive and due to the extreme temperature gradient, may cause rapid alteration of the temperature and character of diffused air flow, thus preventing the room from attaining a uniform, comfortable temperature and presenting a difficult wall and/or ceiling diffuser mounting problem.

Various types of air distribution and mounting systems are known in the art. Typical of these systems is the "Plenum Air Diffuser Assembly" detailed in U.S. Pat. No. 3,406,623, dated Oct. 22, 1968, to R. R. Lambert; U.S. Pat. No. 3,416,425, dated Nov. 19, 1968, also to Lambert; U.S. Pat. No. 3,577,904, dated May 11, 1971, to Lambert; U.S. Pat. No. 3,590,546, dated Jul. 6, 1971, to Lambert; U.S. Pat. No. 3,601,032, dated Aug. 24, 1971, to Lambert; U.S. Pat. No. 3,690,243, dated Sep. 12, 1972, to Lambert; U.S. Pat. No. 3,757,666, dated Sep. 11, 1973, to Lambert; U.S. Pat. No. 3,757,667, dated Sep. 11, 1973, to Lambert; U.S. Pat. No. 3,823,652, dated Jul. 16, 1974, to Lambert; U.S. Pat. No. 3,837,269, dated Sep. 24, 1974, to Lambert; and U.S. Pat. No. 4,426,918, dated Jan. 24, 1984, also to Robert J. Lambert.

It is an object of this invention to provide ceiling clips for mounting and supporting flanged air diffusing devices in the ceiling or wall of a structure.

Another object of this invention is to provide ceiling and wall clips for mounting and supporting flanged air diffusing devices in the ceiling near the wall of a structure.

It is yet another object of this invention to provide a new, improved and inexpensive mounting system for installing a flanged air diffused or bar in the ceiling, wall or ceiling and wall of a structure.

A still further object of the invention is to provide new and improved ceiling and wall brackets for supporting linear and modular flanged air bag systems, which brackets are simple to install and integrate into conventional ceiling and wall configurations.

A still further another object of the invention is to provide specially configured ceiling and wall brackets for mounting linear and modular air bag diffusers in the ceiling and/or wall of a structure, which brackets may be so arranged that they may be quickly and easily snapped onto or otherwise mounted in an existing ceiling or wall plenum air handling system at a desired location without the necessity of extensive custom design work in the ceiling support or wall system.

Another object of this invention is to provide new and improved ceiling and wall mounting brackets for a flanged-equipped linear and modular air bar having an improved, aesthetically pleasing, aerodynamic design which provides a high air volume at low pressure drop and low sound power levels, using an improved air slot design that facilitates a desirable "surface effect" in the air flow.

Still another object of the invention is to provide slidably engageable, specially configured ceiling and wall brackets for engaging horizontally-spaced flanges provided in modular air bars which are fitted with a pair of laterally slidable pattern controllers that facilitate comfortable air distribution in a room at reduced air volume with minimal air "dumping".

Yet another object of the invention is to provide a specially configured ceiling and wall bracket system for supporting a horizontally-flanged, manually-adjustable air bar diffuser which may be totally integrated with a suspended ceiling or wall system, wherein the device becomes either a fixed or removable component of the structure and does not necessarily require relocation with tenant improvement.

Another object of this invention is to provide wall and ceiling brackets for linear and modular air bar diffusers, which brackets are suitable in design to support the diffusers for use as a transition between different types of ceilings in a structure and for wall applications, as well as flat-mount applications in a wall or in a ceiling support system.

Still another object of this invention is to provide specially configured ceiling and wall brackets for engaging parallel, spaced horizontal flanges in linear and modular air diffuses or air bars which are characterized by a pair of vertically-spaced deflectors having facing, curved air channels therein and spaced by an air slot, with a pair of spacers provided in each end of the deflectors and also having pattern controllers laterally slidably mounted between the spacers for deflecting air flowing through the air bar across the curved air channels and through the air slot in a direction which is determined by the position of the pattern controllers. The brackets may be attached to the ceiling and/or wall of the structure with bolts, screws or like fasteners and are designed to slidably engage the bottom and top spacer seats of the air bar to support the air bar in a structure at any desired location.

SUMMARY OF THE INVENTION

These and other objects of the invention are provided in new and improved ceiling and wall brackets for mounting linear and modular air bars designed for insertion in conventional ceiling support systems, which air bars include horizontal, parallel, spaced side flanges and a pair of spaced, curved deflectors that receive bottom and top end spacers containing laterally slidably-mounted pattern controllers, for directing the air through air passages defined by the deflectors and the pattern controllers, respectively, into a structure in a selected direction and volume. The ceiling and wall brackets engage the side flanges to facilitate more efficiently suspending the air bars in a ceiling or on a wall, or both.

BRIEF DESCRIPTION OF THE DRAWINGS

The invention will be better understood by reference to the accompanying drawings, wherein.

DESCRIPTION OF THE PREFERRED EMBODIMENTS

Figures 1, 5:
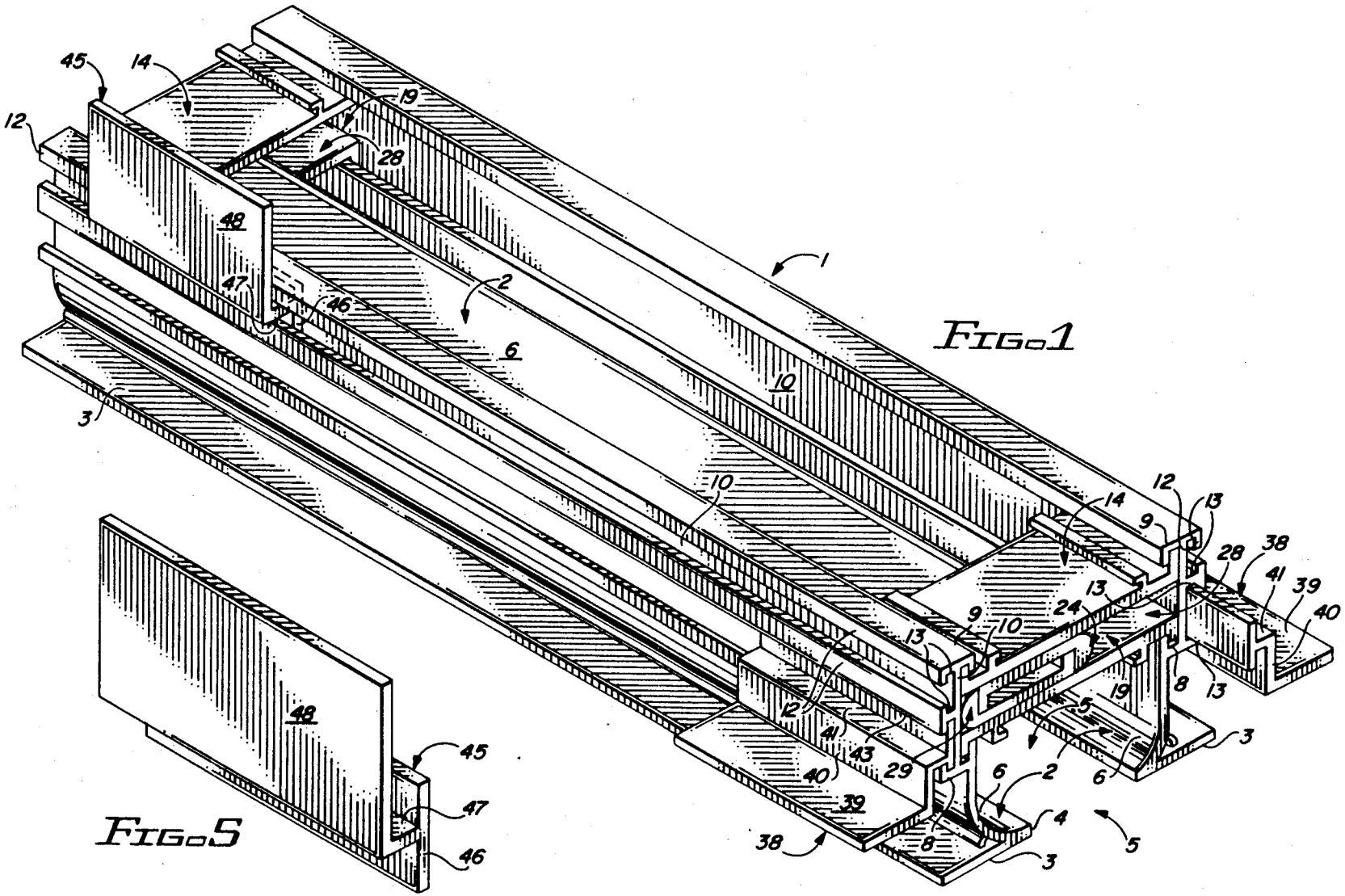
FIG. 1 is a perspective view of a preferred embodiment of the ceiling and wall clips of this invention in functional disposition engaging a modular air bar.
FIG. 5 is a perspective view of a preferred wall clip of this invention.

Referring to FIGS. 1–5 of the drawings, a modular air bar suspended and mounted by the clips of this invention is generally illustrated by reference numeral 1 and includes a pair of vertically-spaced deflectors 2, each fitted with a horizontally oriented, outwardly-extending deflector base 3. Each deflector base 3 terminates along one edge in a base edge 4, which extends in parallel relationship with respect to the opposite base edge 4 to define an air slot 5. Each of the deflectors 2 is further provided with a curved air channel 6 which extends upwardly from the base edges 4, respectively. A bottom spacer seat 8 is shaped in each of the deflectors 2 and a top spacer seat 9 is located above and opposite the bottom spacer seat 8 and is separated therefrom and connected thereto by a spacer seat connector 10, respectively. Each spacer seat connector 10 further includes spaced, outwardly-extending connector flanges 12, having opposed flange seats 13, in order to receive one or more ceiling clips 38 and wall clips 45, which engage the connector flanges 12 and mount the modular air bar 1 to ceiling panels 50 and/or a wall panel 51, as illustrated in FIGS. 2–5. A top spacer 14 and bottom spacer 19 space the deflectors 2 in parallel relationship and are interchangeable in the modular air bar 1. A top pattern controller 24 is slidably seated in the space between the top spacer 14 and the bottom spacer 19 and a companion bottom pattern controller 29 is also fitted in the space between the top spacer 14 and the bottom spacer 19 in slidable contact with the bottom spacer 19 and the top pattern controller 24. It will be appreciated from a consideration of FIGS. 2–4 that the top pattern controller 24 and the bottom pattern controller 29 are laterally slidably disposed in the space between the top spacer 14 and the bottom spacer 19 along the length of the deflector 2 to engage the left-hand spacer seat connector 10 and the bottom pattern controller 29 can be manually slidably extended to the right (or upwardly, in the configuration illustrated in FIG. 4) to engage the right-hand, (or top) spacer seat connector 10. This sliding operation of the top pattern controller 24 and the bottom pattern controller 29 controls the flow of air through the air passages 28 and air slot 5 of the modular air bar 1.

Referring again to FIGS. 1 and 2 of the drawings, while the modular air bar 1 may be suspended from the plenum ceiling (not illustrated) by hangar wires (not illustrated) in conventional fashion using appropriate hanger brackets, in a most preferred embodiment of this invention the hanger wires are replaced by spaced sets of oppositely-disposed ceiling clips 38. The ceiling clips 38 are typically spaced along the length of the modular air bar 1 and are shaped and designed to facilitate attachment to horizontal ceiling panels 50, which engage the respective deflector bases 3 in the deflectors 2 of the modular air bar 1 as illustrated in FIG. 2, and are supported by conventional hangers (not illustrated). The ceiling clips 38 are designed to engage the oppositely-disposed flange seats 13 shaped in the connector flanges 12 of the parallel spacer seat connectors 10 of the modular air bar 1 to stabilize the ceiling clips 38 in the position illustrated in FIGS. 1–4. Accordingly, the vertical ceiling clip engaging flange 43 of the ceiling clip 38 is designed to slidably engage the opposite, spaced flange seats 13 and seat the oppositely-disposed horizontal ceiling flanges 39 flat on the tops of the ceiling panels 50, where they may be optionally secured by suitable fasteners (not illustrated) to securely support the modular air bar 1 in position for distributing air from the ceiling plenum (not illustrated) into a room below (not illustrated). Each ceiling clip 38 is further characterized by a vertical spacer 40, extending in perpendicular relationship from one edge of the ceiling flange 39, a horizontal spacer shoulder 41 projecting inwardly from the vertical spacer 40, also in 90° relationship, and a ceiling clip engaging flange 43, which projects vertically from the spacer shoulder 41 and extends below the horizontal plane of the spacer shoulder 41 to create a shoulder slot which receives the corresponding upward-turned connector flange 12.

Figure 2:
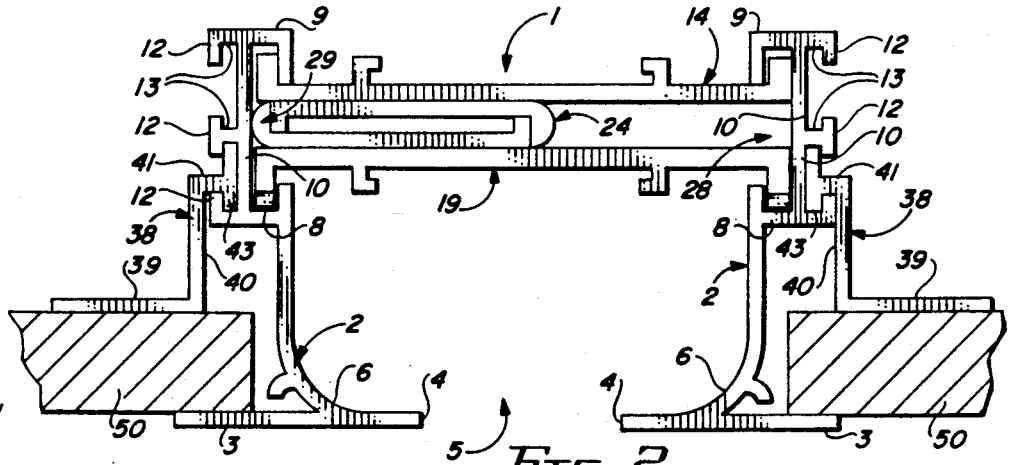
FIG. 2 is a front view of the modular air bar illustrated in FIG. 1 supported by a pair of ceiling clips in a ceiling installation.
Figure 3:
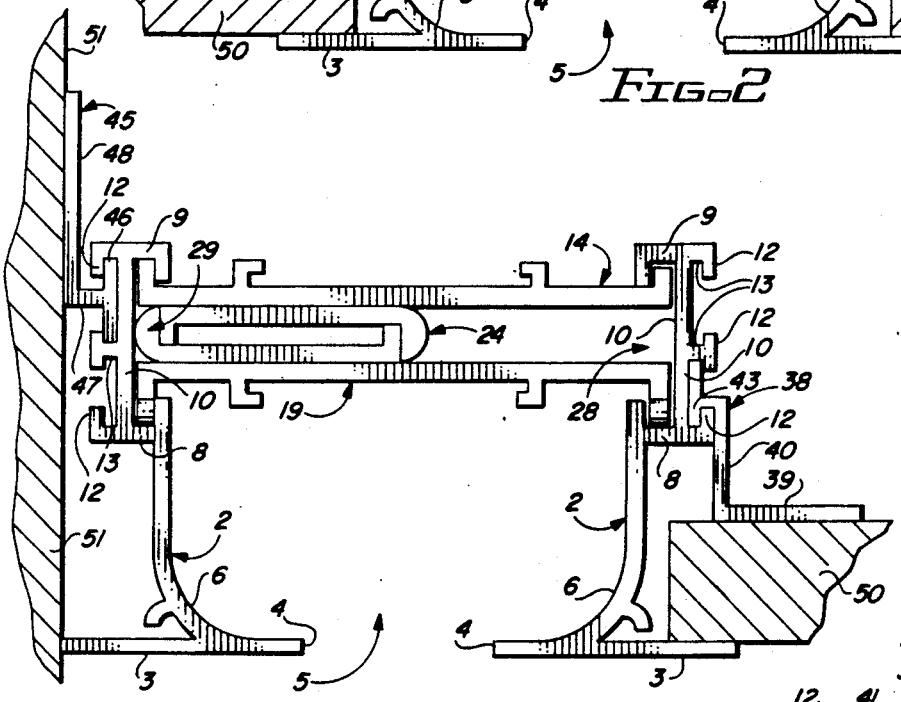
FIG. 3 is a front view of the modular air bar illustrated in FIG. 1 supported by a wall clip and a ceiling clip in a ceiling installation near a wall.

Referring now to FIGS. 3 and 5 of the drawings, in another preferred embodiment of the invention the modular air bar 1 is suspended adjacent to a wall 51 with one edge resting on a ceiling panel 50. As in the case of the modular air bar 1 installation illustrated in FIG. 2, the extending edge of the modular air bar 1 is supported by the ceiling panel 50 using a ceiling clip 38, with the horizontal ceiling flange 39 resting on the top of the ceiling panel 50 and the corresponding vertical ceiling clip engaging flange 43 inserted in opposing flange seats 13 of corresponding connector flanges 12. The opposite edge of the modular air bar 1 is supported on the wall 51 by means of the wall clip 45, wherein the vertical wall flange 48 fits against the wall 51 and may be secured to the wall 51 by means of suitable fasteners such as screws, bolts or the like (not illustrated). A horizontal spacer 47 projects horizontally from the bottom edge of the wall flange 48 and terminates in a vertically-oriented wall clip engaging flange 46, which slidably engages corresponding, opposed top flange seats 13 in corresponding connector flanges 12 extending from the spacer seat connector 10. Accordingly, it will be appreciated from a consideration of FIG. 3, that by using both ceiling clips 38 and wall clips 45 spaced along the length of the modular air bar 1 in the illustrated configuration, the modular air bar 1 can be quickly and easily mounted in a ceiling plenum adjacent to a wall of a structure, as desired.

Figure 4:
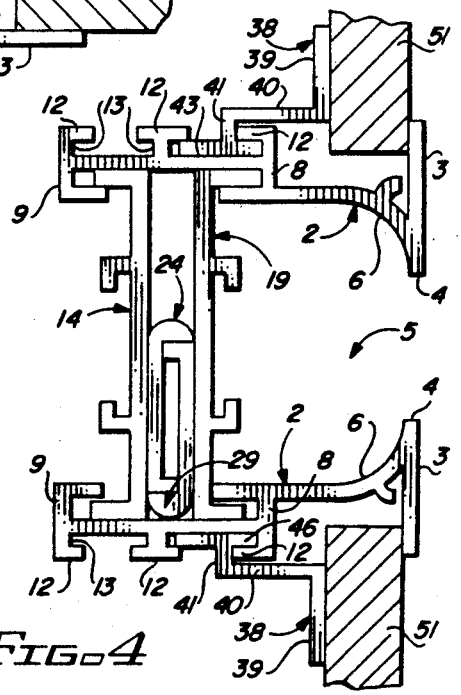
FIG. 4 is wall-mounted air bar supported by a pair of ceiling clips wherein the air bar is mounted in a wall.

Referring to FIG. 4 of the drawing, in yet another preferred embodiment of the invention two sets of ceiling clips 38 can be utilized to mount the modular air bar 1 in a wall under circumstances where it is desired to distribute air from a plenum defined by the wall and an inner surface (not illustrated). Accordingly, the ceiling clips 38 can be mounted to the wall 51 in the same manner as illustrated in FIG. 2, with the modular air bar 1 and the ceiling clips 38 oriented in a 90° configuration with respect to the orientation illustrated in FIG. 2. It will be appreciated that suitable fasteners such as screws, bolts and the like (not illustrated) can be inserted in openings (not illustrated) provided in the respective ceiling flanges 39 to secure the ceiling clips 38 to the wall 51 in spaced relationship, as illustrated in FIG. 4.

It will be further appreciated from a consideration of the drawings that the ceiling clips 38 and wall clips 45 of this invention provide convenient mechanisms for mounting a modular air bar 1 or similar air distribution system provided with upper and lower connector flanges 12 and flange seats 13 in substantially any ceiling or wall air distribution system. Under circumstances where the ceiling clips 38 are used to mount the modular air bar 1 in a ceiling installation as illustrated in FIG. 2, there is usually necessity for using fasteners such as bolts, screws or the like, since the modular air bar 1 is securely, yet removably and adjustably, mounted upon adjacent ceiling panels 50 between the respective ceiling flanges 39 of the ceiling clips 38 and the spaced deflector base 3 in the deflectors 2 of the modular air bar 1. However, fasteners may be used in such a mounting configuration, as required. Since the respective ceiling clip engaging flanges 43 are slidably seated in the opposed lower flange seats 13 of the corresponding connector flanges 12, the modular air bar 1 can be quickly and easily removed from its location and replaced or adjusted, as desired. Similarly, as illustrated in FIG. 4, the ceiling clips 38 may be utilized to mount the modular air bar 1 in an opening in a wall 51, utilizing suitable fasteners to secure the respective ceiling flanges 39 to the wall 51 in spaced relationship, as heretofore described. Furthermore, as illustrated in FIG. 3, the ceiling clips 38 may be combined with the wall clips 45 to secure the modular air bar 1 in position in a slot or space between the ceiling panel 50 and the wall 51, also as heretofore described.

Referring again to FIG. 1 of the drawing, it will be further appreciated by those skilled in the art that multiple units of the ceiling clip 38 and wall clip 45 may be inserted in spaced relationship in the corresponding top and bottom flange seats 13, respectively, of the modular air bar 1, depending upon the length of the modular air bar 1 which is to be fabricated for use in the structure. The spacing of the respective ceiling clips 38 and wall clips 45 may be determined by trial and error, it being only necessary to use a sufficient number of ceiling clips 38 and/or wall clips 45 to provide the necessary support for the modular air bar 1.

It will be further understood by those skilled in the art that the ceiling clips 38 and wall clips 45 may be constructed of any desired material, including plastic or metal such as aluminum or steel, as desired. Furthermore, the ceiling clips 38 and wall clips 45 may be extruded or fabricated from flat strips of metal, according to the knowledge of those skilled in the art.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In an air distribution apparatus having spaced receiving flanges supporting horizontal spacers carrying sliding pattern controllers above spaced ceiling panels in a ceiling, the improvement in combination therewith comprising a plurality of ceiling clips, each having an engaging flange adapted for engaging said receiving flanges; a spacer shoulder extending horizontally in substantially perpendicular relationship from said engaging flange; a spacer extending vertically in substantially perpendicular relationship from said spacer shoulder; and a ceiling flange extending horizontally in substantially perpendicular relationship from said spacer and engaging the ceiling panels, respectively, whereby said ceiling clips support the air distribution apparatus on the ceiling panels.

2. In an air distribution apparatus having a first receiving flange and a second receiving flange supporting horizontal spacers carrying sliding pattern controllers spaced from an opening between a wall and a ceiling panel and air deflectors extending into the opening, the improvement in combination therewith comprising a plurality of ceiling clips, each comprising a ceiling clip engaging flange for engaging said first receiving flange above the ceiling panel; a first spacer shoulder extending horizontally in substantially perpendicular relationship from said ceiling clip engaging flange; a first spacer extending vertically in substantially perpendicular relationship from said first spacer shoulder; and a ceiling flange extending horizontally in substantially perpendicular relationship from said first spacer for engaging the ceiling panel, whereby one edge of the air distribution apparatus is supported on the ceiling panel, and a plurality of wall clips, each comprising a wall clip engaging flange adapted for engaging said second receiving flange adjacent to the wall; a second spacer shoulder extending horizontally in substantially perpendicular relationship from said wall clip engaging flange; and a wall flange extending vertically in substantially perpendicular relationship from said second spacer shoulder for engaging the wall, whereby the opposite edge of the air distribution apparatus is supported by said wall clips and the wall at the wall opening.

3. In an air distribution apparatus having spaced receiving flanges supporting vertical spacers carrying sliding pattern controllers at an opening in a wall, with air deflectors projecting into the opening, the improvement in combination therewith comprising a plurality of ceiling clips, each having a engaging flange adapted for engaging said receiving flanges; respectively, a spacer shoulder extending vertically in substantially perpendicular relationship from said engaging flange; a spacer extending horizontally in substantially perpendicular relationship from said spacer shoulder; and a wall flange extending vertically in substantially perpendicular relationship from said spacer and engaging the wall on each side of the wall opening, respectively, whereby said wall clips support the air distribution apparatus on the wall at the wall opening.

* * * * *